US006550756B2

(12) United States Patent
Trovinger

(10) Patent No.: US 6,550,756 B2
(45) Date of Patent: Apr. 22, 2003

(54) APPARATUS FOR ADVANCEMENT OF PAPER IN A NON-LINEAR PATH

(75) Inventor: Steven W Trovinger, Los Altos, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 88 days.

(21) Appl. No.: 09/820,740

(22) Filed: Mar. 30, 2001

(65) Prior Publication Data

US 2002/0140150 A1 Oct. 3, 2002

(51) Int. Cl.[7] ..... B31B 1/68

(52) U.S. Cl. ..... 270/52.26; 270/32; 270/37; 270/52.3; 493/405; 493/416; 493/436

(58) Field of Search ..... 270/32, 37, 52.26, 270/52.3; 493/405, 416, 436

(56) References Cited

U.S. PATENT DOCUMENTS 3,692,300 A * 9/1972 Mebus ..... 270/52.26
5,137,264 A * 8/1992 Cloutier et al. ..... 270/58.02
5,377,965 A * 1/1995 Mandel et al. ..... 270/37
5,615,871 A * 4/1997 Kleinhen ..... 270/45
5,921,752 A * 7/1999 Sinke et al. ..... 416/16
5,975,182 A * 11/1999 Hartmann et al. ..... 156/538
6,099,225 A 8/2000 Allen et al.
6,251,054 B1 * 6/2001 Cruz et al. ..... 270/32

FOREIGN PATENT DOCUMENTS

EP 0992365 A1 4/2000
EP 1086810 A1 3/2001
WO 00/18583 4/2000

OTHER PUBLICATIONS

Berger P: "Investieren Mit Blink Auf Digitale Nischenprodukte" Deutscher Drucker, Deutscher Drucker Verlagseellschaft, Ostfildern, DE, vol. 34, No. 35 (Sep. 17, 1998—09—17) pp. W45, W48 XP000783487 Relevant Claim No. 1, 8, 13.

* cited by examiner

*Primary Examiner*—Patrick H. Mackey

(57) ABSTRACT

A method for handling a material sheet in a sheet-wise booklet making system, including the steps of advancing a sheet to a movable clamping drive at a first position, clamping the sheet in the clamping drive at the first position, moving the clamping drive in a non-linear path to a second position, establishing a fold in the sheet with a folding device, moving the clamping drive in a non-linear path to a third position, and delivering the folded sheet to a collecting device, such that a leading side and a trailing side of the folded sheet are respectively delivered to a frontside and a backside of the collecting device.

17 Claims, 9 Drawing Sheets

APPARATUS FOR ADVANCEMENT OF PAPER IN A NON-LINEAR PATH

BACKGROUND OF THE INVENTION

1. Field of the Invention

The present invention generally relates to finishing printed sheets of paper and, more particularly, to delivering individual folded sheets to a collecting device in a non-linear path.

2. Background Information

A system for finishing printed sheets into booklets is described in U.S. Pat. No. 6,099,225 (Allen et al., hereafter referred to as "the Allen patent"), hereby incorporated by reference in its entirety, where most finishing operations are performed on a sheet-by-sheet basis using precise paper positioning. The system also uses a transverse tool carrier for cutting, scoring, folding, punching, and stapling booklet sheets. Also described in the Allen patent is an inverted V-shaped workpiece for collecting folded booklet sheets. However, no specific methods for transporting folded booklet sheets from an upstream component to the V-shaped workpiece are disclosed in the Allen patent.

Another system for making saddle-stitched booklets on a sheet-wise basis is disclosed in PCT No. WO 00/18583 (Trovinger et al., hereafter referred to as "the Trovinger PCT"), hereby incorporated by reference in its entirety. In this system, folded booklet sheets are forwarded from a folding device to a reciprocating saddle with the use of a secondary drive system. In such a forwarding system, the path of the sheets is a straight, horizontal line, while the folded sheets are accumulated in a vertical fashion (i.e., on the saddle), that is, normal to the sheet path. A reciprocating saddle as described in the Trovinger PCT addresses the problem of transporting a trailing side of a folded sheet onto the backside of a saddle, but requires a large amount of space to allow the saddle to reciprocate or sweep.

Accordingly, what is needed is a compact and accurate system for properly transporting individual folded booklet sheets from an upstream device to a collecting saddle while avoiding harm to the folded edges of the sheets.

SUMMARY OF THE INVENTION

The present invention is directed to a system for moving folded sheets from an upstream device to a collecting device in a non-linear path, where each sheet is delivered to the collecting device such that a leading side and a trailing side of the sheet are respectively delivered to a frontside and a backside of the collecting device.

According to an exemplary embodiment of the present invention, a method for handling a material sheet in a sheet-wise booklet making system is provided, comprising the steps of advancing a sheet to a movable clamping drive at a first position, clamping the sheet in the clamping drive at the first position, moving the clamping drive in a non-linear path to a second position, establishing a fold in the sheet with a folding device, moving the clamping drive in a non-linear path to a third position, and delivering the folded sheet to a collecting device, wherein a leading side and a trailing side of the folded sheet are respectively delivered to a frontside and a backside of the collecting device.

According to another embodiment of the present invention, an apparatus for handling flat material is provided, comprising a main drive for advancing sheet material, a saddle for collecting sheet material, a rotatable arm and a clamping drive, wherein the clamping drive clamps sheet material and wherein the rotatable arm operates to move the clamping drive about an axis from the main drive to the saddle, and a folding device for establishing a fold in sheet material while sheet material is clamped by the drive system.

According to a further embodiment of the present invention, a method for handling a material sheet is provided, comprising the steps of clamping the sheet using a movable clamping drive, establishing a fold in the sheet, and moving the clamping device along a non-linear path to deliver the sheet to a collecting device, such that a leading side and a trailing side of the sheet are respectively delivered to a frontside and a backside of the collecting device.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1A:
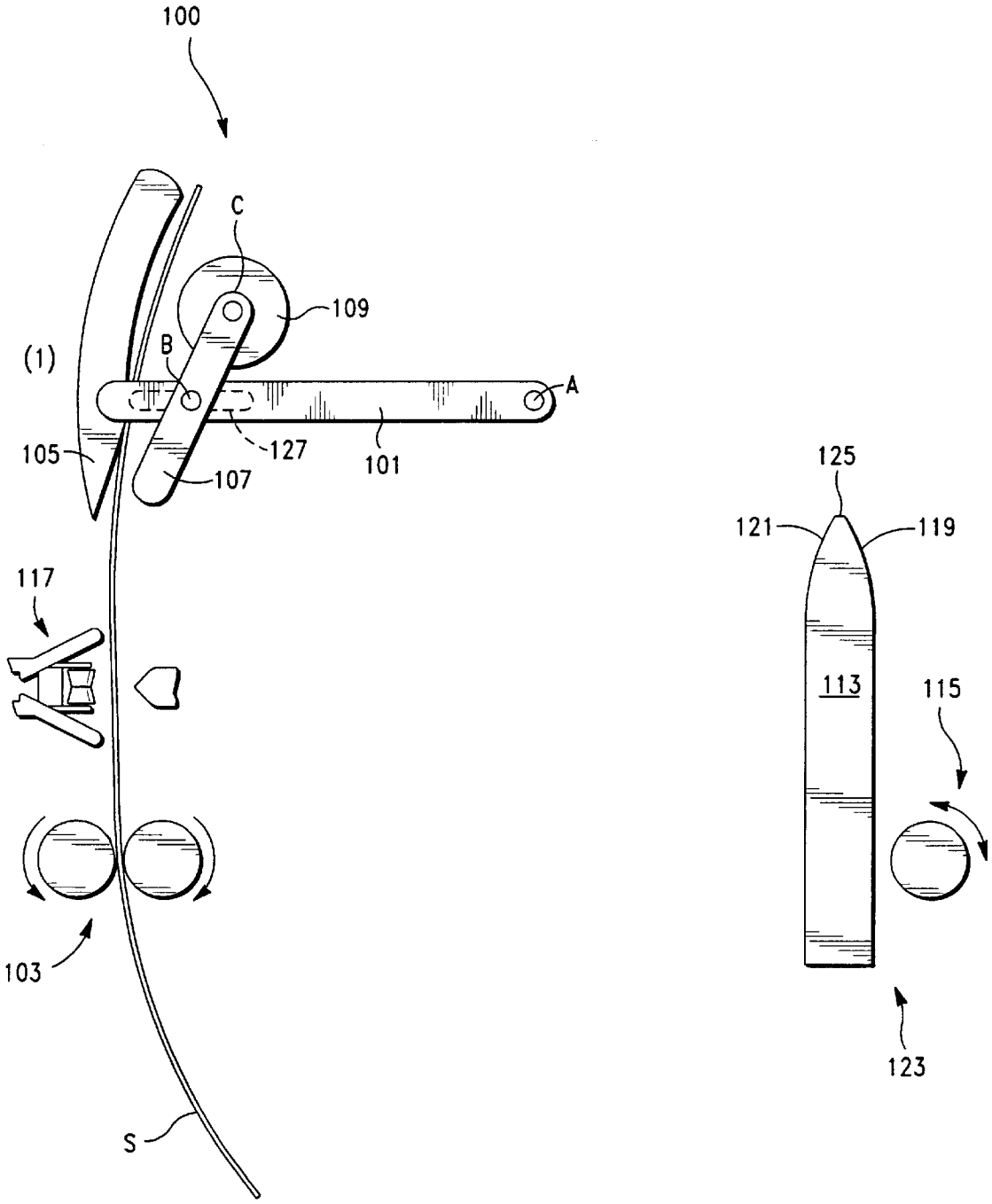
FIGS. 1*a–d* are schematic views of a flipper system in different positions in accordance with an embodiment of the present invention.

FIGS. 2*a–e* illustrate a system referred to as a flipper device, so named because it "flips" sheet material from an from upstream device to a collecting device in a non-linear path. The system operates as a movable sub-system within a larger sheet-wise booklet making system and includes an arm 201 and a movable clamping device 200. By using a fixed foot 205, a draft shaft 207, and drive tires 209, clamping device 200 is operable both as a clamping and driving device. That is, clamping device 200 clamps flat material by moving draft shaft 207 to press tires 209 against foot 205; clamping device 200 drives or advances flat material by rotating tires 209 while the flat material is clamped.

Arm 201 and clamping device 200 rotate about pivot points A, which lie along a horizontal axis, although the present invention is not limited to this orientation. A collecting device 213, which collects folded sheet material (e.g., paper to be stapled into a booklet), is shown in relation to clamping device 200 and arm 201. In the FIGS. 2*a–e* embodiments, clamping device 200 is shown to extend across the entire width of a booklet sheet, where pivot points A are located at the sides of the flipper device and away from the edges of a booklet sheet. This arrangement leaves a middle area clear for moving the trailing edge of a folded sheet onto collecting device 213.

Figure 1B:
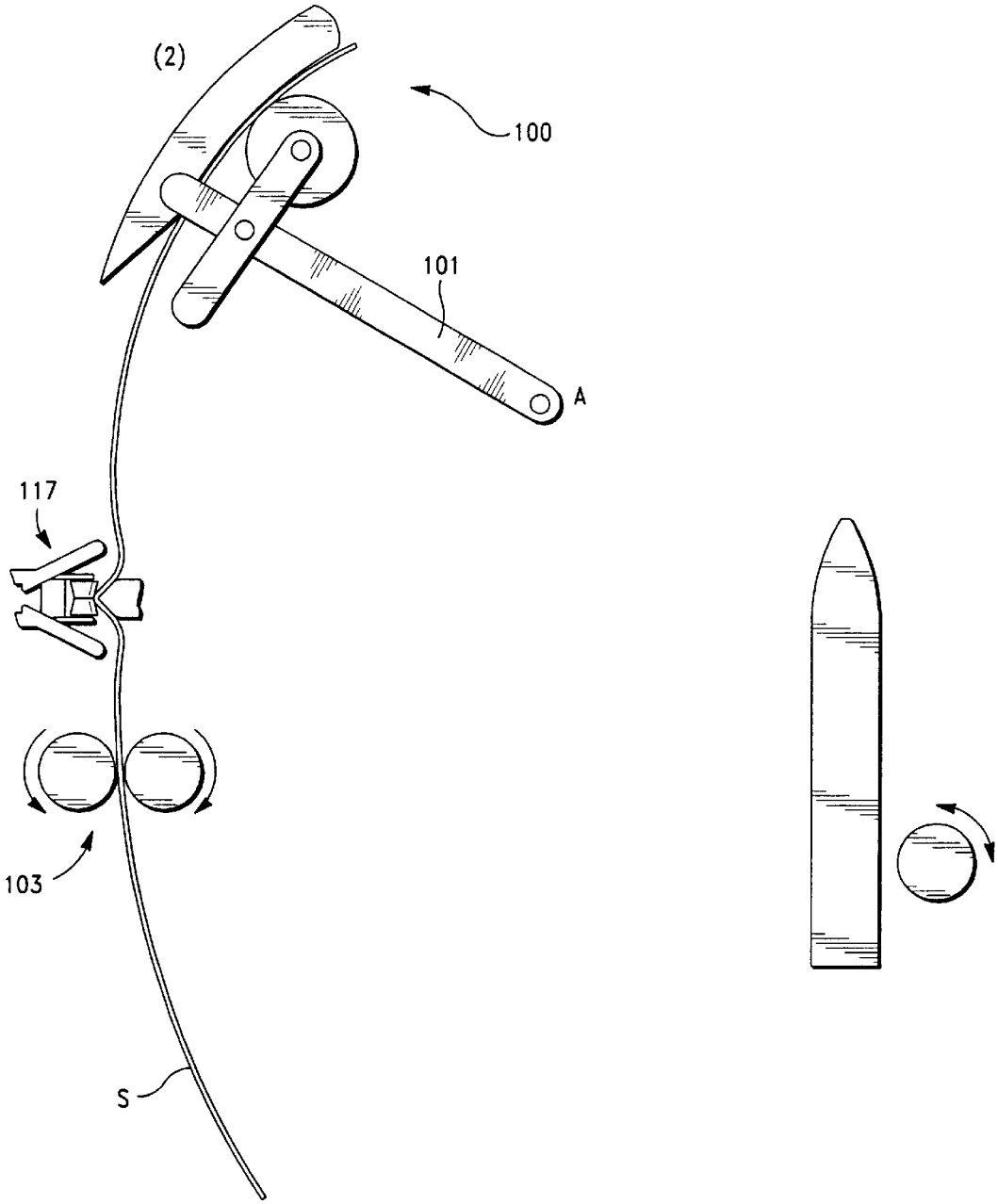
Figure 1C:
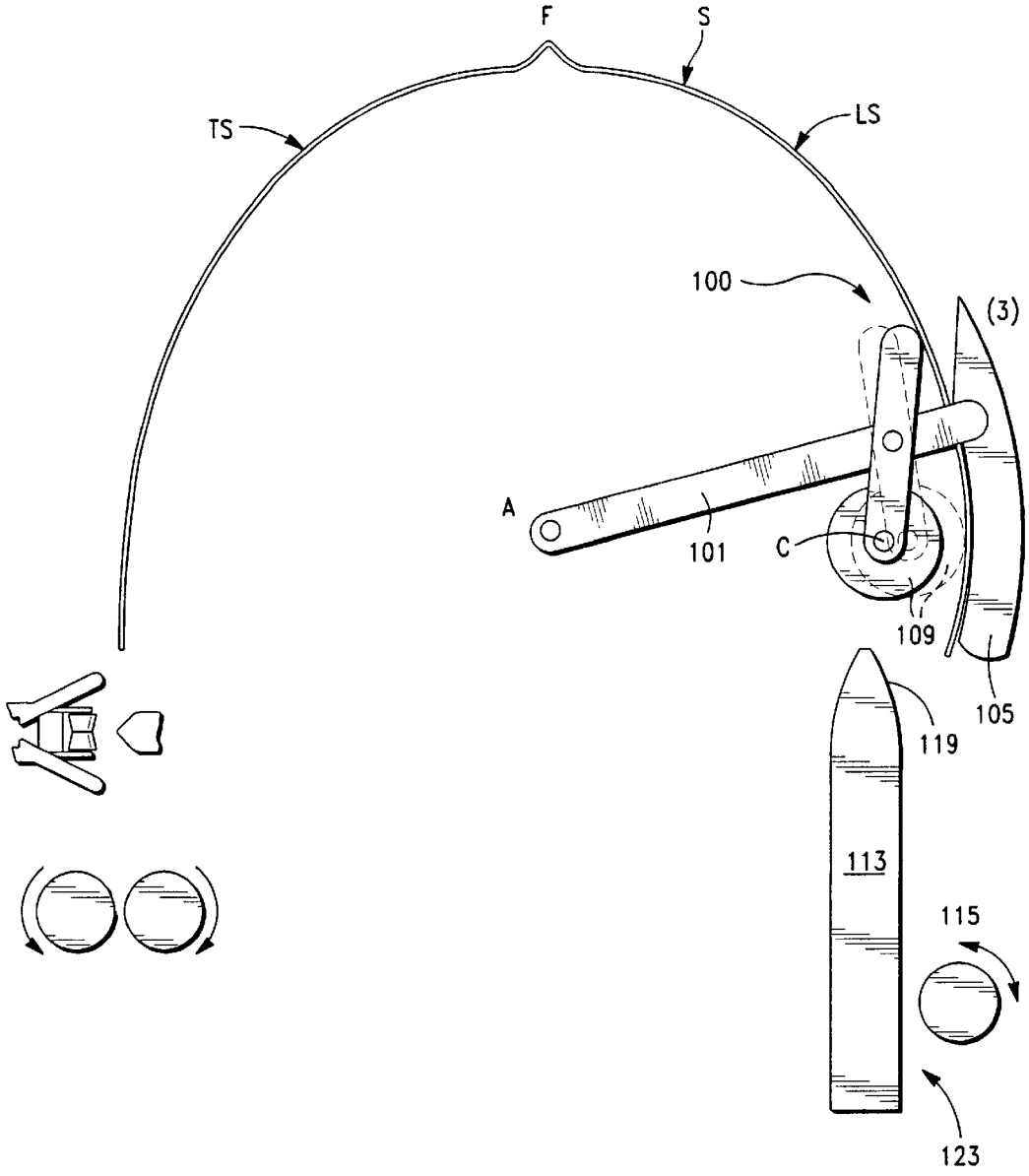
Figure 1D:
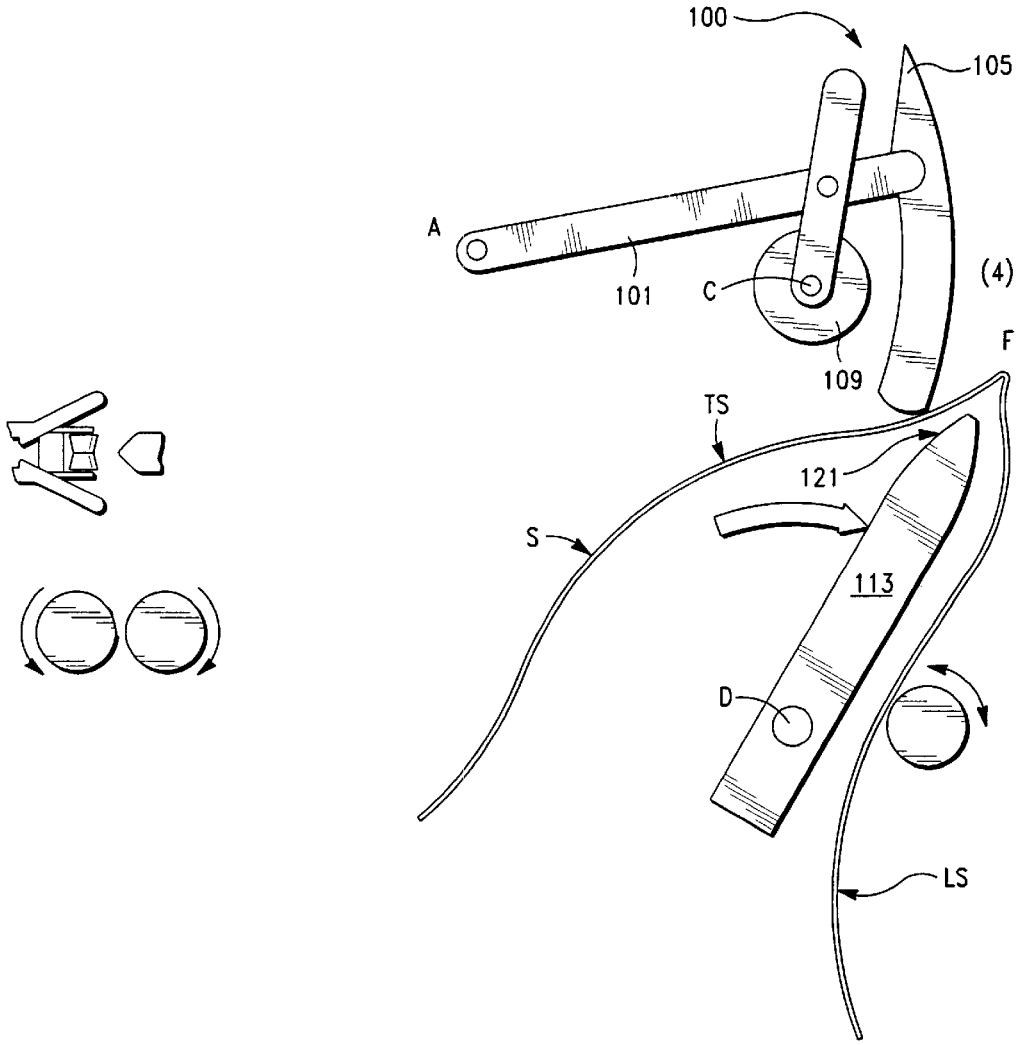
Figure 2A:
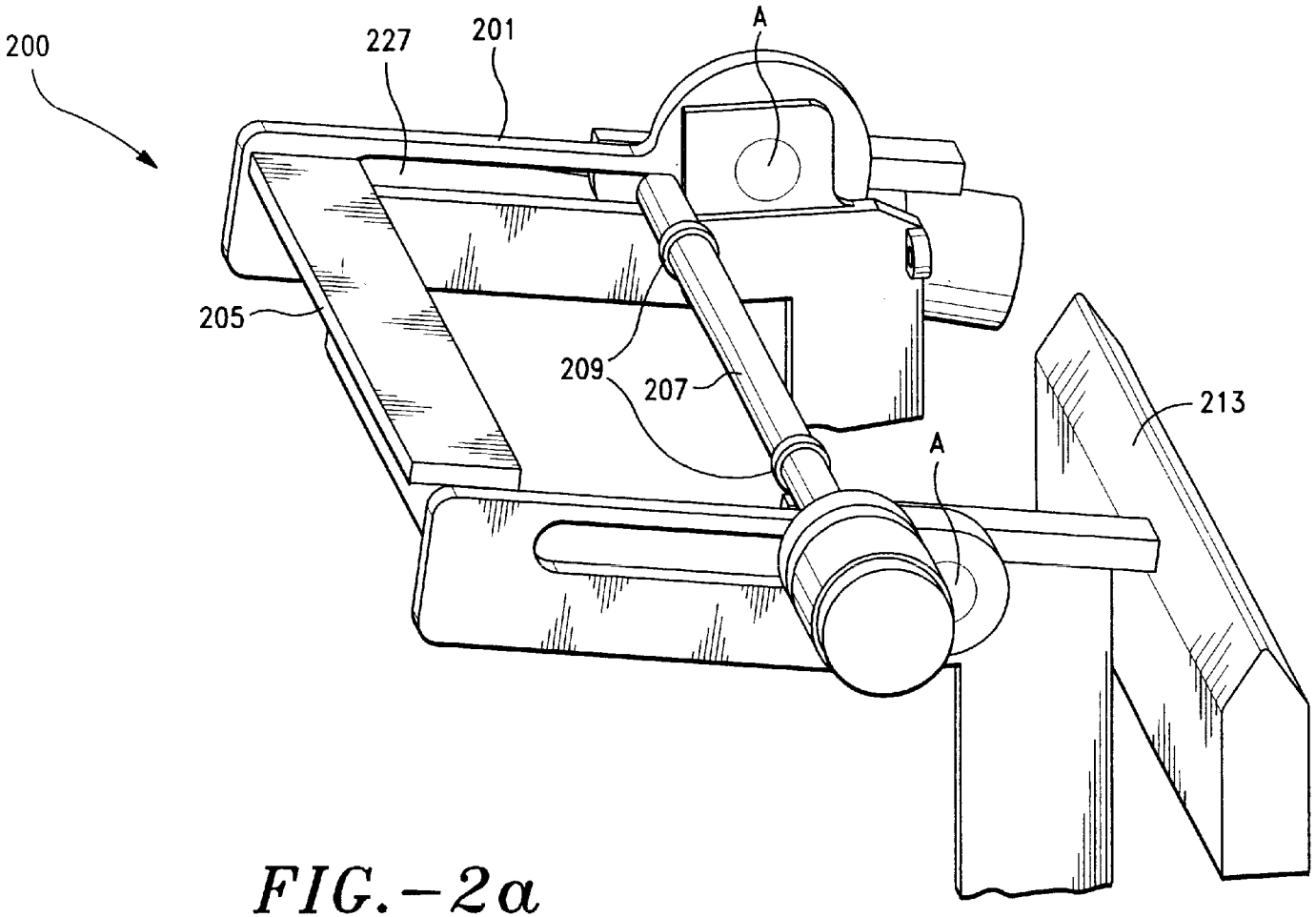
FIGS. 2*a–e* are perspective views of a flipper system in different positions in accordance with an embodiment of the present invention.
Figure 2B:
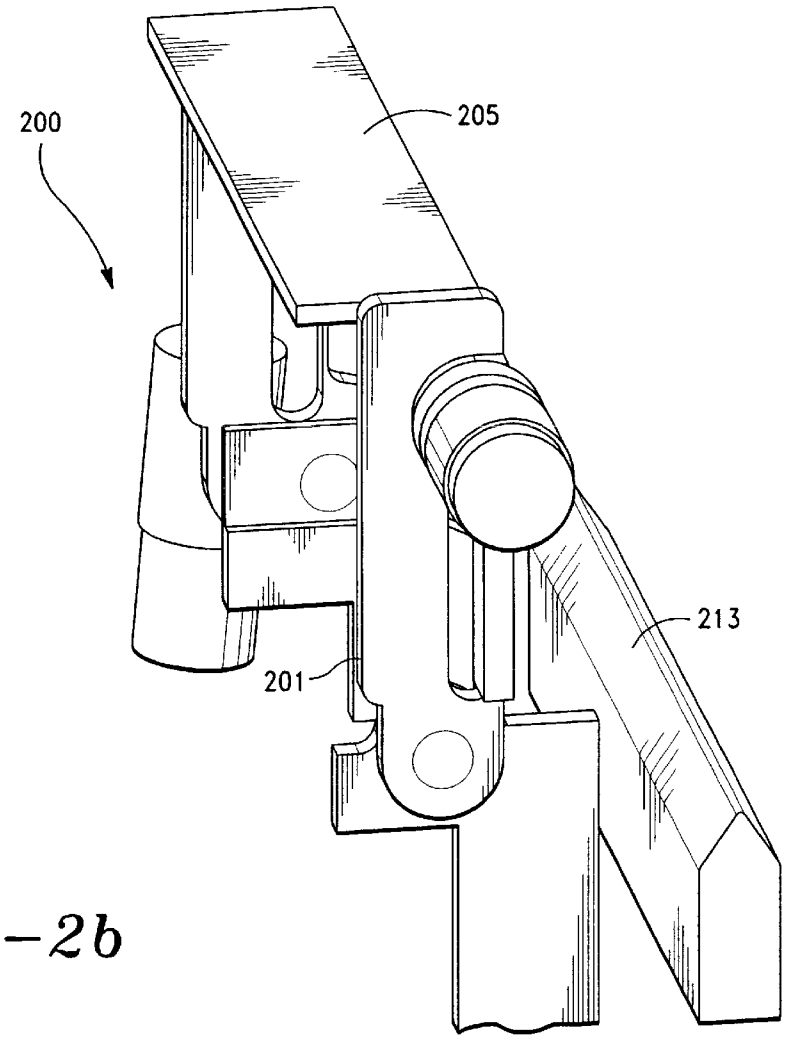
Figure 2C:
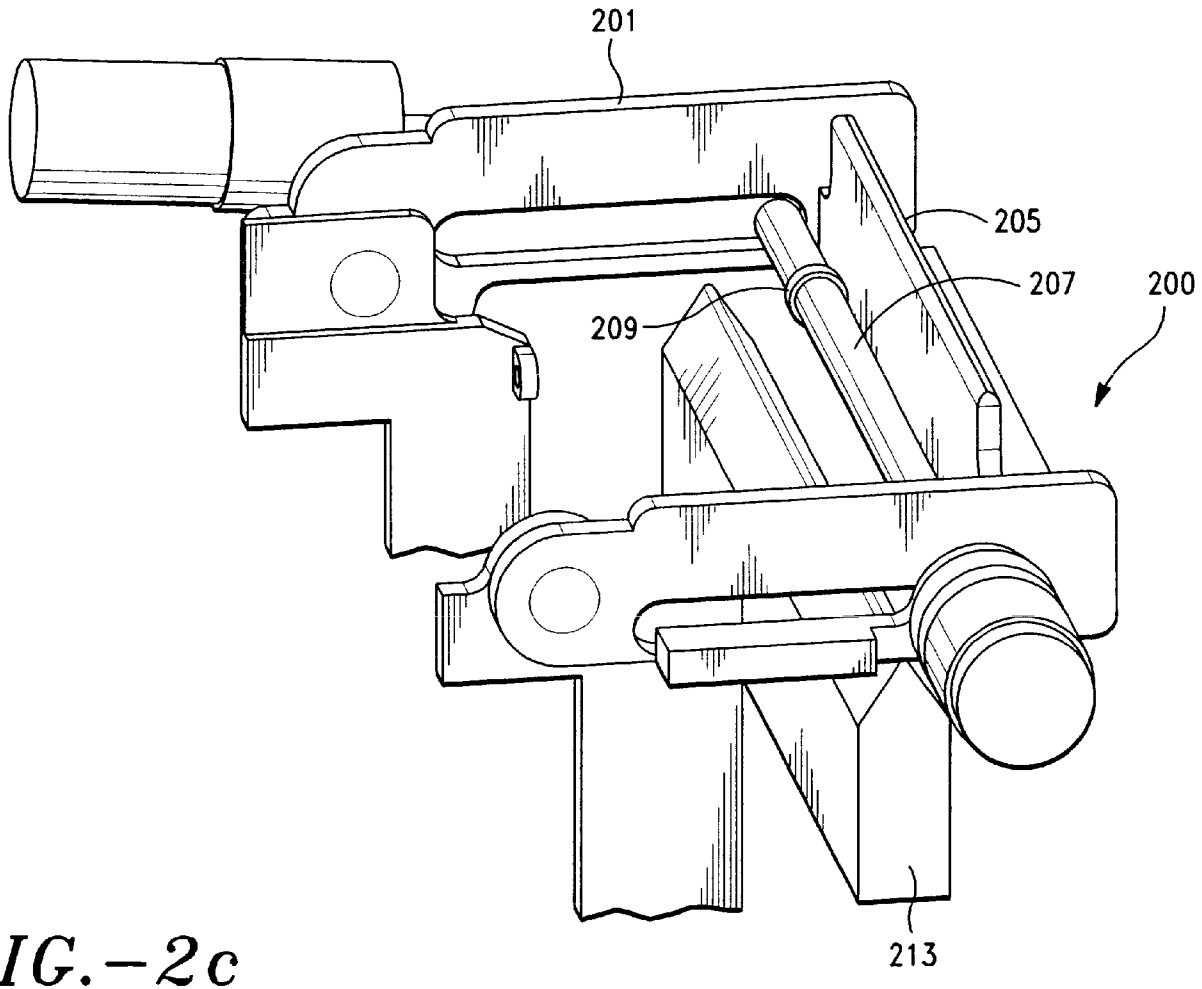

During sheet-wise operation, clamping device 200 receives a single flat sheet from a main drive while in a load position (shown in FIG. 2*a*), and delivers the received sheet as a folded sheet to collecting device 213 while in an unload position (shown in FIG. 2*c*). In this way, clamping device 200 is moved along a non-linear path to deliver the sheet to collecting device 213, such that a leading side and a trailing side of the sheet are respectively delivered to a frontside and a backside of collecting device 213. The use of a flipper device therefore has the advantage of saving space by directing individual booklet sheets in a non-linear path (e.g., a 180° path). As this path is "folded back on itself", a more compact sheet-wise booklet making system is provided. The above operation is represented in FIGS. 1*a–d* and will be described, along with additional steps, with reference to the flipper device of FIGS. 2*a–e*.

FIG. 1*a* corresponds to FIG. 2*a* and shows a clamping device 100 in a loading or first position (1), where a single booklet sheet S is advanced by main paper drive 103 into and through a folding apparatus 117 (shown in a non-operational or "open" position). Similar to clamping device 200 described above, clamping device 100 operates as a movable clamping drive for clamping and driving sheet S, and includes a draft shaft 107, a drive tire 109, and a fixed foot 105. Sheet S is advanced to extend past folding device 117, and the leading edge of sheet S enters the clamping device 100. In position (1), draft shaft 107 and drive tire 109 are positioned away from fixed foot 105 (represented as draft shaft 207, drive tires 209, and fixed foot 205 in FIG. 2*a*). This allows sheet S to be advanced by main drive 103 into clamping device 100 and to pass between the foot 105 and tires 107, 109.

Draft shaft 107 and drive tire 109 are then rotated around pivot point B towards foot 105, thereby achieving a closed position and clamping a portion of sheet S against fixed foot 105. Alternatively, sheet S is clamped by clamping device 100 by linearly or non-linearly translating draft shaft 107 and drive tire 109 towards fixed foot 105 along, for example, a guide path 127 (shown in FIG. 2*a* as guide path 227).

An arm 101 then moves the clamping device 100 to intermediate or second position (2), shown in FIG. 1*b*. In the embodiment represented in the figure, arm 101 is shown to be a rotatable arm, while the movement of the arm is shown to be a clockwise rotation. The present invention is not, however, limited to this type of movement. Also, the figure illustrates the corresponding clamping device 200 position as being vertical, but the present invention is not limited to this configuration in performing the below steps. As clamping device approaches position (2), main drive 103 advances sheet S forward until a position at which sheet S it is to be folded is located over folding apparatus 117. While clamping device 100 is in position (2), folding device 117 begins to activate and clamps sheet S. Once sheet S is clamped, arm 101 rotates in reverse direction (e.g., counter-clockwise), thereby creating a slack loop in sheet S. This slack loop allows sheet S freedom to move when a fold is created.

Once folding device 117 establishes a fold F in sheet S, folding device 117 opens to allow sheet S to be freely moved by clamping device 100 in the original direction (e.g., clockwise rotation). After the folding operation, clamping device 100 remains clamped to the leading side LS of folded sheet S (shown in FIG. 1*c*). Alternatively, draft shaft 107 and drive tire 109 are rotated or translated away from foot 105, allowing main drive 103 to advance folded sheet S in such a way that fold F passes between and beyond drive tire 109 and foot 105. Clamping device 100 then clamps the trailing side TS of sheet S without affecting the integrity of fold F.

FIG. 1*c* illustrates clamping device 100 moved by arm 101 to unload or third position (3), which is located around 180 degrees about pivot A from position (1), although the present invention is not limited to this angle. FIG. 2*c* corresponds to FIG. 1*c* by showing clamping device 200 located at an unload position. As clamping device 100 approaches position (3), main paper drive 103 advances now-folded sheet S and completes the handoff to clamping device 100. Alternatively, a portion of trailing side TS may remain in main paper drive 103 when clamping device 100 reaches position (3).

At position (3), folded sheet S is delivered to a collecting device (or saddle) 113, where leading side LS and trailing side TS of folded sheet S are respectively delivered to a frontside 119 and a backside 121 of saddle 113. This operation includes unclamping the folded sheet S and moving the clamping device 100 in a non-linear path from position (3) to the position (1) to allow folded sheet S to exit the clamping device 100. The delivering operation is described in detail below.

While sheet S is still clamped between drive tire 109 and foot 105 (represented in the dotted-line configuration), drive tire 109 (drive tires 209 in FIG. 2*c*) rotates about axis C to drive leading side LS of folded sheet S down against frontside 119 of saddle 113, a component of saddle subsystem 123. Folded sheet S is advanced by drive tire 109 until a saddle secondary or collecting drive 115 located on saddle 113 engages sheet S, thereby transferring sheet S from clamping device 100 to saddle subsystem 123. When the transferring of leading side LS of sheet S is complete, draft shaft 107 and drive tire 109 rotate or translate away from foot 105 (solid-line configuration), releasing folded sheet S. Simultaneously, saddle drive 115 advances sheet S until fold F is located at the top edge 125 of saddle 113.

From unload position (3), arm 101 then moves in the reverse direction (e.g., counter-clockwise rotation), allowing folded sheet S, which is lightly now held between foot 105 and drive tire 109, to slip from clamping device 100 during the rotation. Arm 101 continues to move back to position (1), and during this time a trailing side TS of folded sheet S completely exits the space between foot 105 and drive tire 109. Alternatively, a portion of trailing side TS may remain in the region of folding device 117 and main paper drive 103 as arm 101 moves to position (1) from position (3). In this case, clamping device 100 clamps trailing side TS when it reaches position (1), and arm 101 rotates in the forward (e.g., clockwise) direction to allow trailing side TS to completely exit folding device 117 and main paper drive 103. Clamping device 100 then releases trailing side TS. With trailing side TS of folded sheet S free, saddle 113 pivots slightly about, or translates away from, a pivot point D (shown in FIG. 1*d*) to pull trailing side TS completely clear of clamping device 100. Gravity also assists in pulling trailing side TS down against a backside 121 of saddle 113.

Figure 2D:
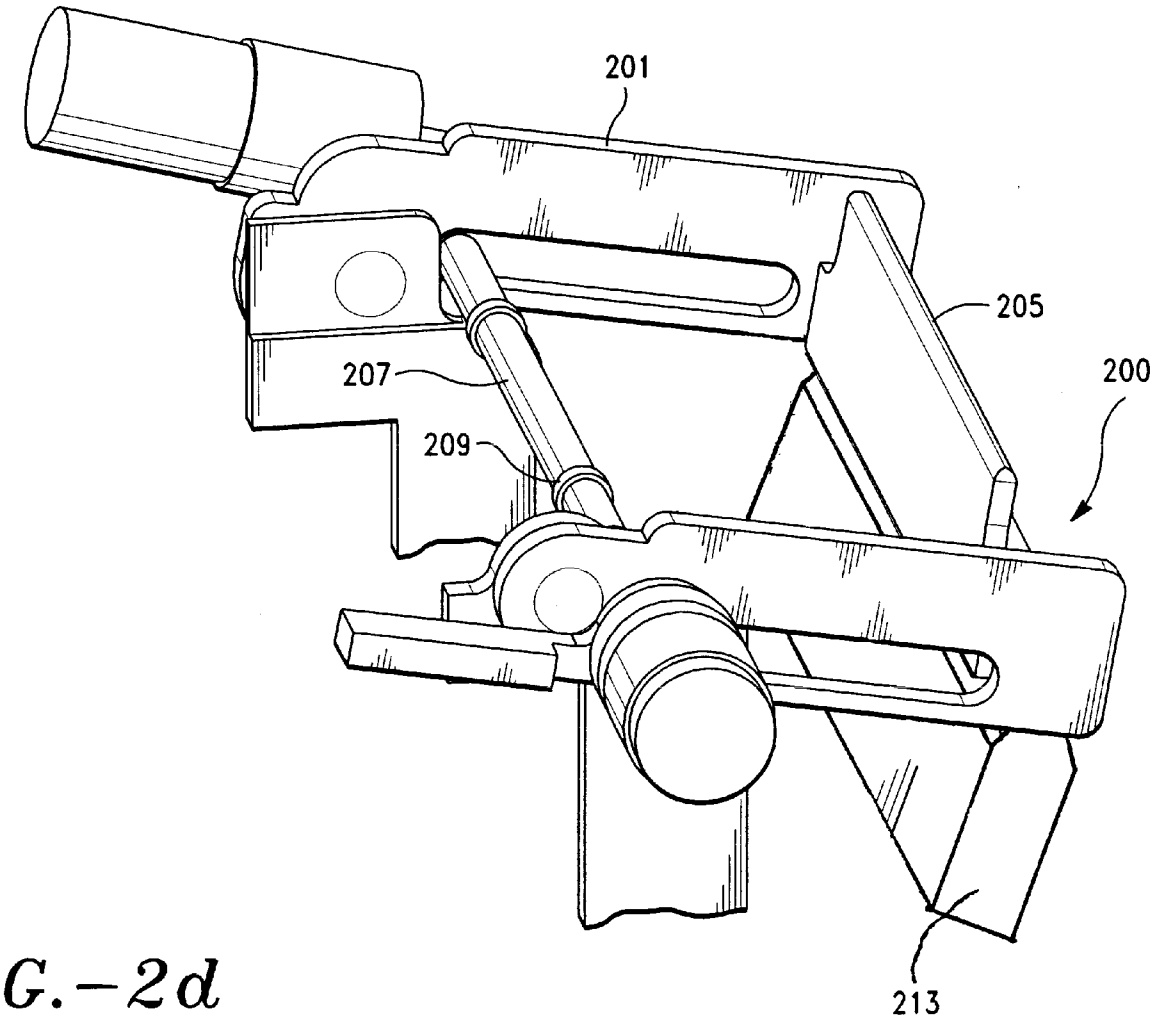
Figure 2E:
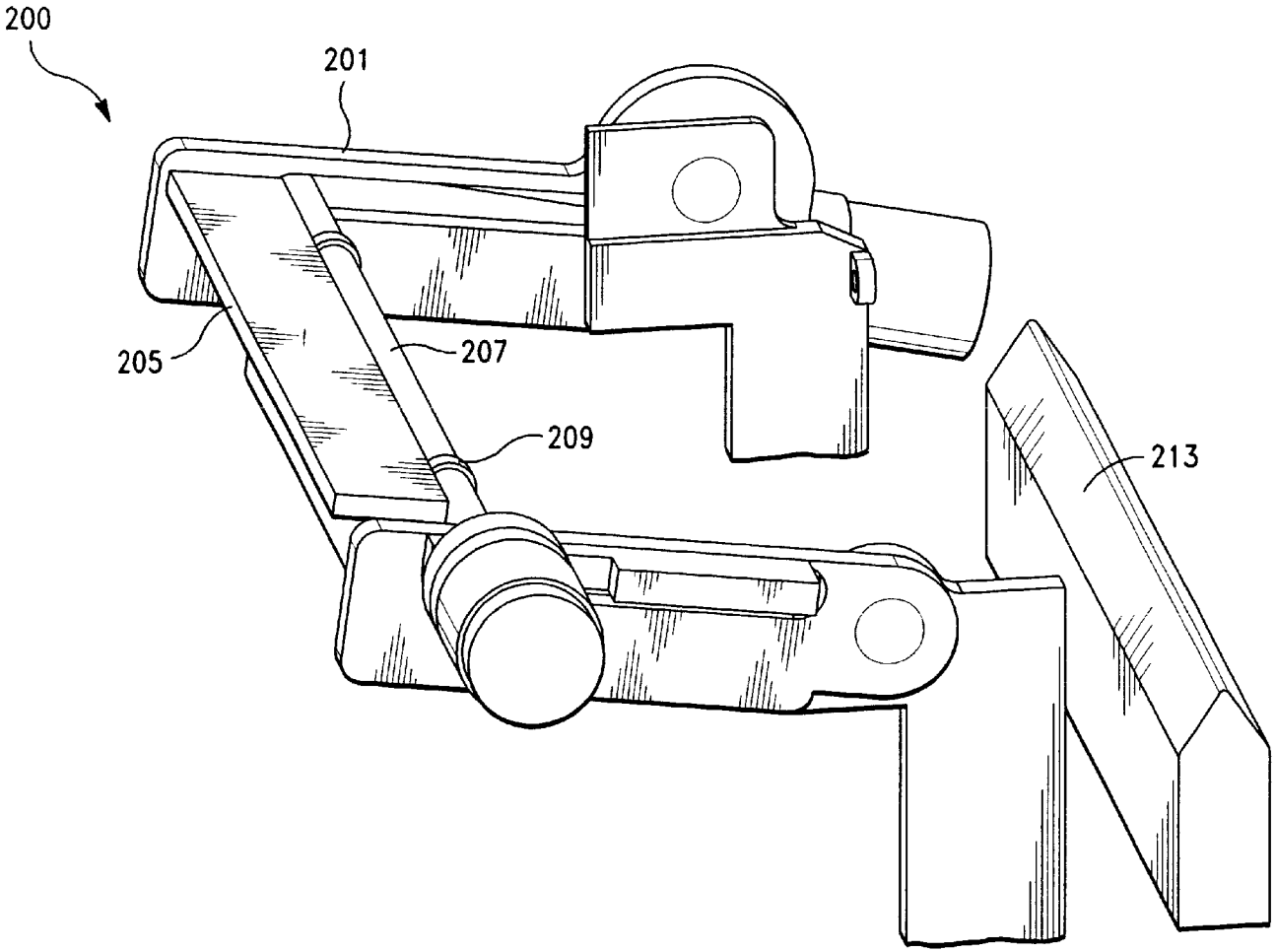

In order to insure that trailing side TS of sheet S arrives smoothly against backside 121 of saddle 113, clamping device 100 is once again moved in the original direction to a sweep or wipe position (4) while saddle 113 is pivoted away, as shown in FIG. 1*d* and in corresponding FIG. 2*d*. Position (4) is located at least beyond position (3) (e.g., more than 180 degrees from position (1)). In this way, arm 101 and foot 105 act to sweep trailing side TS of sheet S against backside 121 of saddle 113. Clamping device 100 then "resets" by returning to position (1) to receive a next sheet S, as shown in corresponding FIG. 2*e*.

In this way, the present invention provides a compact sheet-wise booklet making system by directing individual booklet sheets in a non-linear path, where a leading side and a trailing side of a folded sheet are respectively delivered to a frontside and a backside of the collecting device. In addition, the present invention prevents harm to folded sheet edges during operation of clamping device 100, 200. By allowing drive tire(s) 109, 209 to open and close against a foot 105, 205, a fold F is allowed to slide through the opening between drive tire 109, 209 and foot 105, 205 without being flattened.

In addition, the present invention allows scalability; because clamping device 100, 200 pivots as well as contains a drive tire(s) 109, 209, this design can accommodate a wide range of sheet sizes. Using typical paper sensors, once leading and trailing limits of a sheet are known, clamping device 100, 200 can be positioned and driven to adjust for different sheet sizes. In this way, a single system can be designed to accommodate material sheets of a wide variety of sizes. For example, such a system could transport both material sheet of "small" sizes (e.g, a 120 mm×120 mm CD-ROM booklet) and larger, "regular" sizes (e.g., a 8½×11 booklet). Of course, the use of the present invention is not limited to these exemplary sizes.

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A method for handling a material sheet in a sheet-wise booklet making system, comprising the steps of:

advancing a sheet to a movable clamping drive at a first position;

clamping the sheet in the clamping drive at the first position;

moving the clamping drive in a non-linear path to a second position;

establishing a fold in the sheet with a folding device;

moving the clamping drive in the non-linear path to a third position;

delivering the folded sheet to a collecting device by rotating the clamping drive to independently advance the sheet, wherein a leading side and a trailing side of the folded sheet are respectively delivered to a frontside and a backside of the collecting device; and reciprocating the clamping drive to the first position along the non-linear path in a reverse direction.

2. The method of claim 1, wherein the step of clamping comprises the step of clamping the sheet between a drive tire and a foot of the clamping drive.

3. The method of claim 1, wherein the step of moving the clamping drive to a second position comprises the step of advancing the sheet until a position on the sheet at which a fold is to be established is located over the folding device.

4. The method of claim 1, wherein the step of reciprocating comprises the steps of unclamping the folded sheet and moving the clamping drive in a non-linear path from the third position to the first position to allow the folded sheet to exit the clamping drive.

5. The method of claim 4, wherein the step of delivering the folded sheet comprises the step of moving the clamping drive in a non-linear path from the first position to at least the third position, wherein the trailing edge of the folded sheet is forced by the clamping drive onto the backside of the collecting device.

6. The method of claim 1, wherein the material sheet is paper.

7. The method of claim 1, wherein the amount of movement between the first position and the third position is around 180 degrees of rotational movement.

8. An apparatus for handling sheet material, comprising:

a main drive for advancing sheet material;

a saddle for collecting sheet material;

a rotatable arm and a clamping drive, wherein the clamping drive includes a drive tire and a foot, the drive tire and the foot operative to clamp sheet material and wherein the rotatable arm operates to move the clamping drive about an axis from the main drive to the saddle; and a folding device for establishing a fold in sheet material while sheet material is clamped by the drive system.

9. The apparatus of claim 8, wherein sheet material is delivered to the saddle by the clamping drive so that the fold of the sheet material rests on a top edge of the saddle.

10. The apparatus of claim 8, wherein sheet material is delivered to the saddle by the clamping drive so that a leading side of the sheet material rests on one side of the saddle and a trailing side of the sheet material rests on the other side of the saddle.

11. The apparatus of claim 8, wherein the clamping drive clamps a leading side of a folded sheet material.

12. The apparatus of claim 8, wherein the rotatable arm moves the clamping drive about a horizontal axis.

13. A method for handling a material sheet comprising the steps of:

clamping the sheet using a movable clamping drive;

establishing a fold in the sheet;

moving the clamping drive along a non-linear path in a first direction to deliver the sheet to a collecting device, such that a leading side and a trailing side of the sheet are respectively delivered to a frontside and a backside of the collecting device; and reciprocating the clamping drive along the non-linear path in a second direction.

14. The method of claim 13, wherein the step of moving the clamping drive comprises the step of:

rotating the clamping drive about a first axis using an arm; and rotating a drive tire of the clamping drive about a second axis.

15. The method of claim 13, wherein the leading side of the sheet is delivered to the frontside of the collecting device by driving the leading side down against the frontside of the collecting device using a drive tire.

16. The method of claim 13, wherein the trailing side of the sheet is delivered to the backside of the collecting device by moving the clamping drive away from the collecting device after delivery of the leading side of the sheet, and by pivoting the collecting device about an axis such that the trailing side of the sheet is pulled from the clamping drive.

17. The apparatus of claim 8, wherein the drive tire rotates to independently advance the sheet material.

* * * * *